United States Patent [19]

Gfell

[11] 4,080,865

[45] Mar. 28, 1978

[54] PITCH VARYING APPARATUS

[76] Inventor: Edward B. Gfell, 195 E. McMillan, Apt. 4, Cincinnati, Ohio 45219

[21] Appl. No.: 744,989

[22] Filed: Nov. 26, 1976

[51] Int. Cl.[2] ..... G10D 3/14; G10C 3/10

[52] U.S. Cl. ..... 84/312 R; 84/297 R

[58] Field of Search ..... 84/312, 313, 297 R, 84/200

[56] References Cited

U.S. PATENT DOCUMENTS

| | | | |
|---|---|---|---|
| 2,257,995 | 10/1941 | Abrams et al. | 84/312 P |
| 2,949,806 | 8/1960 | Turman | 84/313 X |
| 3,763,735 | 10/1973 | Land | 84/312 |

*Primary Examiner*—Lawrence R. Franklin

*Attorney, Agent, or Firm*—Melville, Strasser, Foster & Hoffman

[57] ABSTRACT

Apparatus for varying the pitch of at least one of the strings of a stringed instrument, comprising a rotatable shaft means, to which one or more of the strings of the stringed instrument may be connected, and a lever arm attached to the rotatable shaft means for providing rotation of the shaft.

4 Claims, 4 Drawing Figures

PITCH VARYING APPARATUS

BACKGROUND OF THE INVENTION

1. Field of the Invention

The apparatus of the present invention relates generally to devices for varying the pitch of stringed instruments, and more particularly to a device for varying the pitch of at least one of the strings of a stringed instrument.

2. Description of the prior art

Numerous methods for raising or lowering the pitch of a stringed instrument are known and described in the prior art. Typical pitch changing devices for stringed instruments, generally relating to guitars and the like, are shown, for example, in U.S. Pat. No. 2,893,282 issued to T. F. Searles, U.S. Pat. No. 3,142,221 issued to S. O. Boyd, and U.S. Pat. No. 3,457,821 issued to T. M. McCarty et al. Each of these devices disclosed operates to raise or lower the pitch of the excited string of the stringed instrument with which it is associated by shortening or lengthening the string, usually upon command by the instrumentalist via a hand or foot operated mechanism, thereby imparting color to the music. The devices disclosed by the prior art affect all strings simultaneously, thus changing the pitch of all the strings.

Although many of these devices are known and have been used by performers for some time, none permit the artist to express his full range of musical feelings by permitting variation in pitch of less than all of the strings of the instrument. In addition, none of these devices permit pitch coloration of less than all strings by the performer in stringed instruments having a large number of strings, such as a keyboard instrument, and more particularly stringed instruments such as the clavinet, an instrument which is widely used by modern performers. It is believed that the lack of this pitch varying feature in modern keyboard instruments, such as the clavinet, and more particularly the inability of the performer to vary the pitch of less than all of the strings, has presented a serious impediment to the growth of modern music and its enjoyment by the general public.

Therefore, it would be highly desirable to provide a device for use with stringed instruments having a large number of strings, such as a clavinet, whereby the performer could vary, at his discretion, the pitch of one or more of the strings of the instrument.

SUMMARY OF THE INVENTION

The tone varying apparatus of the present invention includes a rotatable shaft extending between and supported by rectangular mounting blocks attached to the keybed frame of the stringed instrument in which the pitch varying apparatus is contained. The rotatable shaft comprises a rigid cylindrical shaft having a number of serially spaced pins to which the strings of the stringed instrument may be attached by means of a loop formed in the end of the string. One end of the rotatable shaft is secured to a bushing having a diameter slightly larger than that of the shaft, thereby permitting the shaft to rotate freely. The other end of the rotatable shaft passes through a bushing contained in a rectangular mounting block of similar construction, and terminates in a lever arm mounted perpendicularly to the rotatable shaft. The lever arm is a cylindrical shaft of extended length which has attached to the end furthermost from the rotatable shaft a rod passing through the keyboard frame and terminating in a foot pedal beneath the musical instrument which can be actuated by the performer. When the foot pedal is actuated by the performer, the lever arm is raised or lowered, thereby causing the rotatable shaft to rotate through a small angle and thereby lengthening or shortening the strings secured to the rotatable shaft and producing a variation in the pitch of the strings.

The rectangular mounting blocks bearing the rotatable shaft are fixably attached to the keybed frame and support a cylindrical shaped bridge. Those strings not attached to the rotatable shaft are supported by the bridge and terminate at anchor pins attached to the keybed frame adjacent thereto.

The keybed frame supports the rectangular mounting blocks and the anchor pins terminating the strings adjacent to the bridge. The other end of the strings terminate in a tuning machine mounted on the keybed frame. Acoustic pickups may be located above and beneath the strings to provide electronic amplification of the musical tones. Damper means may also be included to provide variation in the intensity of the excited strings.

DESCRIPTION OF THE PREFERRED EMBODIMENTS

Figure 1:
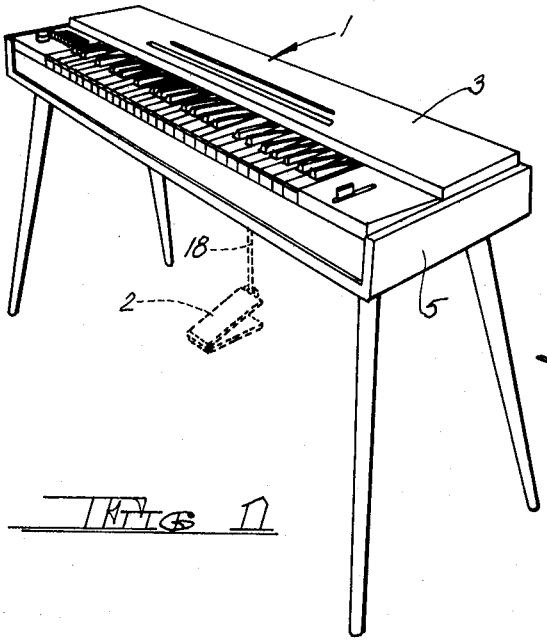
FIG. 1 is a perspective view of a clavinet containing the present invention.

To understand the preferred embodiments, reference is made to FIG. 1 which shows, in a perspective view, a typical clavinet 1 containing the present invention. A foot pedal 2 is located directly beneath the clavinet and may be used by the performer in conjunction with the present invention to vary the pitch of the strings of the clavinet. It will be understood by one skilled in the art that other keyboard instruments may employ the pitch varying apparatus and in addition that the pitch varying apparatus may be actuated by a hand control (not shown) rather than a the foot pedal mechanism as illustrated.

Figure 4:
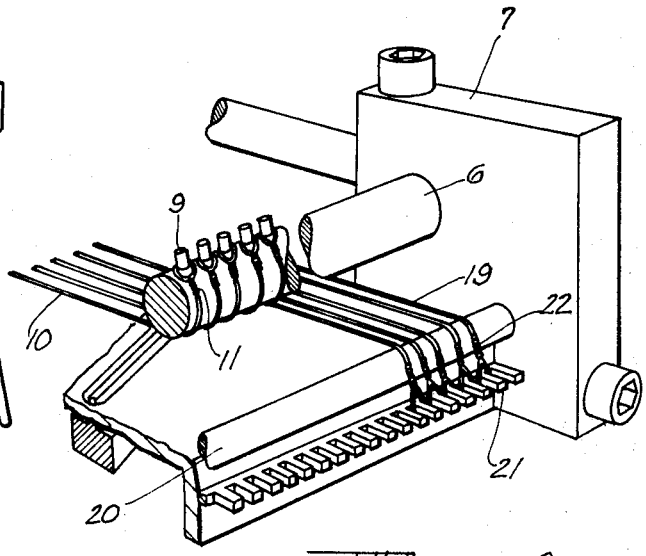
FIG. 4 is a fragmentary perspective view detailing the pitch varying apparatus.
Figure 2:
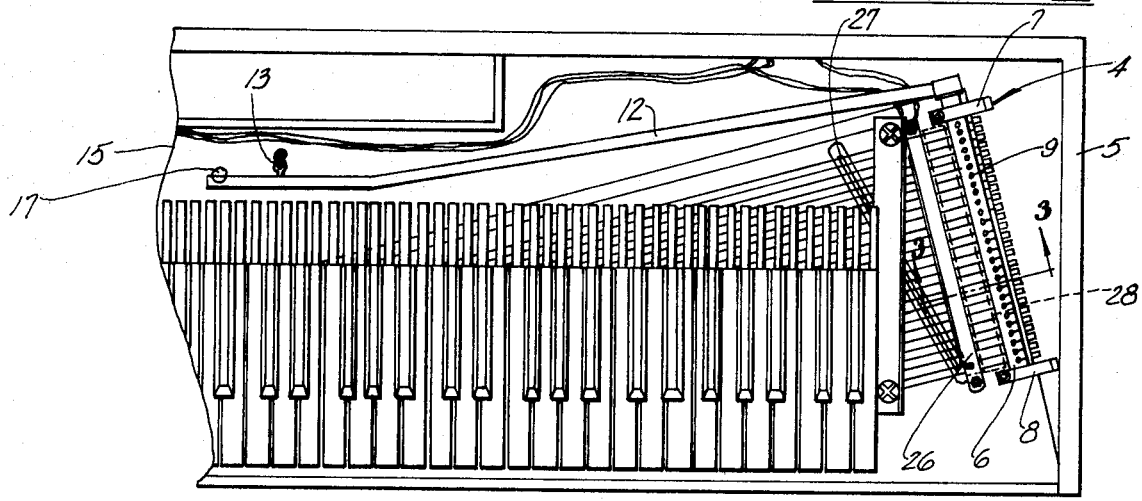
FIG. 2 is a fragmentary plan view of the interior of the clavinet shown in FIG. 1.
Figure 3:
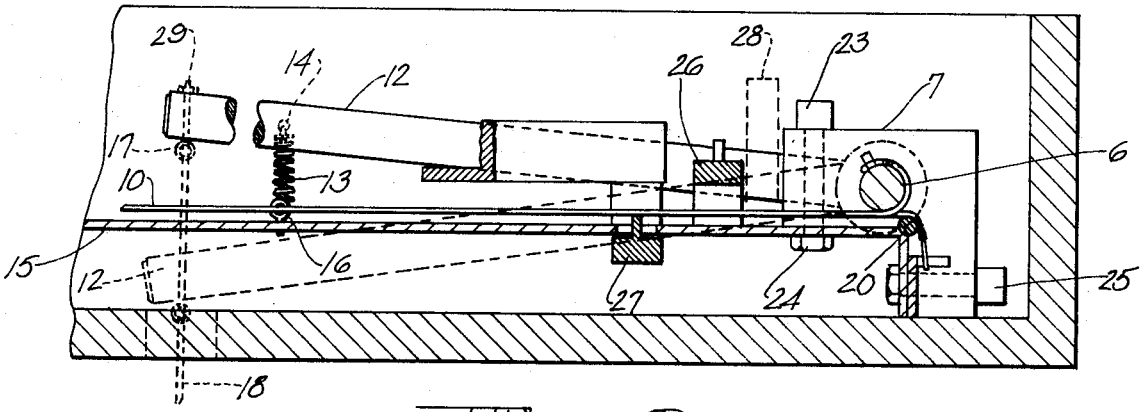
FIG. 3 is a fragmentary cross sectional view taken along section line 3—3 of FIG. 2 and shows the lever arm in an alternate activated position.

Turning now to FIGS. 2, 3 and 4 (wherein like elements have been given like index numerals), FIG. 2 illustrates a fragmentary plan view of the clavinet 1 with the top cover 3 of the clavinet removed to show the interior. The pitch varying apparatus 4 appears at the right side of the clavinet case 5 and angularly disposed from the sides thereof. The pitch varying apparatus 4 comprises a rotatable cylindrical shaft 6 supported at its ends by rectangular blocks 7 and 8. Disposed longitudinally along the length of the rotatable shaft 6 are a series of regularly spaced pins 9, each pin lying along the axis of a string 10 of the stringed instrument. At least one of the strings 10 is attached to its corresponding pin 9 by wrapping the string around the rotatable shaft 6 and securing the end of the string 10 to the pin 9 by means of a loop 11 at the end of the string. The other end of each string is secured to a tuning machine or similar attachment (not shown). It is preferred that when the rotatable shaft 6 is in its normal at rest position, the strings 10 attached to the shaft 6 will circumscribe an angle of more than 180° around the shaft, thus permitting each string to maintain its proper tension. It will be appreciated that the performer may select which string or strings, as desired, he wishes to attach to the pins 9 located on shaft 6 that are to be controlled by the pitch varying apparatus.

As is best seen in FIG. 2, one end of the rotatable shaft 6 is inserted into and retained by a bushing (not shown) having a slightly larger diameter than the shaft 6 and located in rectangular block 8, thus leaving the shaft free to rotate. The other end of the shaft 6 is retained by a similar bushing located in block 7 and is passed through block 7, thus leaving the entire rotatable shaft 6 free to rotate about its axis. It will be appreciated by one skilled in the art that upon a rotational displacement of shaft 6, the tension in strings 10 will increase or decrease, thereby producing a corresponding change in the pitch of strings. The end of the shaft 6 passing through rectangular block 7 is fixedly attached to lever arm 12. Lever arm 12 is maintained in its normal at rest position by spring means 13 secured to lever arm 12 by a hole 14 passing through lever arm 12 and to the keybed frame 15 by a threaded hook 16 passing through keybed frame 15. A cylindrical rod 18 is secured to the uppermost end of lever arm 12 as at 29 and passes through a hole in the base of the clavinet case 5. The lowermost end of the rod 18 is secured to the free end of the foot pedal 2 which assumes the position shown in FIG. 1 when the lever arm 12 is in its normal or at rest position.

When the performer wishes to vary the pitch of the strings 10 attached to the pitch varying apparatus 4, the foot pedal 2 is depressed placing the rod 18 in tension and causing the lever arm 12 to assume the position indicated by the dotted lines in FIG. 3. The deflection of the lever arm 12 causes the rotatable shaft 6 to pivot, thereby varying the tension and the pitch of the strings 10 attached to the rotatable shaft 6. Likewise the foot pedal may be operated (not shown) so as to place rod 18 in compression thereby raising lever arm 12 and again varying the tension and pitch of said string 10. When the foot pedal 2 is released, it returns to the normal or at rest position shown in FIG. 1, resulting in the removal of tension and compression from rod 18, thereby permitting lever arm 12 and rotatable shaft 6 to return to their normal or at rest position, and thus permitting strings 10 attached to rotatably shaft 6 to return to their normal pitch. It will be understood that this process may be repeated as often as desired by the performer.

As best shown in FIG. 4, the strings 19 which are not connected to the rotatably shaft 6, pass over bridge 20 and are secured to anchor pins 21 by means of a preformed loop 22 at the end of each string. The anchor pins 21 are rigidly attached to keybed frame 15 as is well known in the art. The other end of strings 22 are attached to a tuning machine or a similar mechanism (not shown). It will be understood that one or more of strings 10 may be removed from rotatable shaft 6 and secured to a corresponding pin 21 at the discretion of the performer; likewise, one or more of strings 19 may be removed from anchor pins 21 and secured to a corresponding pin 9 on rotatable shaft 6.

The base of rectangular mounting block 7 abuts the keybed frame 15 and is secured thereto by a bolt 23 passing vertically through a hole in rectangular block 7 and a coaxial hole in keybed frame 15, and terminating in a suitable nut 24 on the lower surface of keybed frame 15. A similar bolt 25 passes horizontally through a hole in rectangular mounting block 8 and a coaxial hole located on the vertical leg of keybed frame 15, and is secured by a suitable nut to the inner surface of keybed frame 15. Rectangular mounting block 8 is secured in a similar manner to keybed frame 15.

Upper acoustical pickups 26 are located above and adjacent to each string to provide for electronically amplified sounds produced by each string. Similarly lower acoustical pickups 27 are provided beneath and adjacent to each string to provide for electronically amplified sound. Means are also provided for a damper 28 located above and adjacent to each string to vary the intensity of the sound produced by that string.

Modifications may be made in the invention without departing from the spirit of it. For example, while it is preferred that a foot pedal be used to allow the performer to vary the pitch of the strings attached to the rotatable shaft, it would be within the scope of the present invention to provide hand operated means for varying the pitch. Furthermore, while it is again preferred that the pitch varying apparatus described be used with a clavinet, it would not depart from the spirit of the invention to utilize the pitch varying apparatus with other types of stringed instruments, e.g., pianos, organs, clavichords, guitars, etc.

The embodiments of the invention in which an exclusive property or privilege is claimed are defined as follows:

1. In a keyboard instrument of the type having a keybed frame, a tuning machine attached to said frame, a first set of pins attached to said frame, and a first set of strings connected between said first set of pins and said tuning machine, the improvement in combination therewith comprising:

a. a shaft rotatably secured to said keybed frame, said shaft carrying a second set of pins;

b. a second set of strings connected between said tuning machine and said second set of pins;

c. a lever arm attached to one end of said shaft; and, d. means for actuating said lever arm; whereby said lever arm may be actuated and said shaft may be rotated for varying the tension and pitch of said second set of strings as desired.

2. The structure claimed in claim 1, wherein said first and second sets of strings are interchangeable with said first and second sets of pins.

3. The structure claimed in claim 2, wherein said keyboard instrument is a clavinet.

4. The structure claimed in claim 3, wherein said shaft is rotatably secured to said keybed frame by a pair of rectangular mounting blocks rigidly affixed to said frame and supporting said shaft at its ends by cylindrical bushings having diameters larger than that of said shaft, said shaft extending through and protruding from one of said blocks, said shaft also carrying serially spaced cylindrical pins extending substantially the length of said shaft and equal in number to the total number of strings of said clavinet, said second set of strings circumscribing an angle of more than 180° around said shaft and attached to said second set of pins by loops formed in the end of each string, said lever arm comprising an elongated cylindrical bar-like member having one end fixedly secured to said protruding end of said shaft and extending transversely said shaft and parallel to said keybed frame with one end free to move transversely said keybed frame, said means for actuating said lever arm comprising means secured to the free end of said lever arm and passing through said keybedframe, said means terminating in a foot-actuated pedal located beneath said clavinet.

* * * * *